US007108081B2

(12) United States Patent
Boyadjieff

(10) Patent No.: US 7,108,081 B2
(45) Date of Patent: Sep. 19, 2006

(54) INSTRUMENTED INTERNAL BLOWOUT PREVENTER VALVE FOR MEASURING DRILL STRING DRILLING PARAMETERS

(75) Inventor: George Boyadjieff, Villa Park, CA (US)

(73) Assignee: Varco I/P, Inc., Orange, CA (US)

( * ) Notice: Subject to any disclaimer, the term of this patent is extended or adjusted under 35 U.S.C. 154(b) by 11 days.

(21) Appl. No.: 11/027,849

(22) Filed: Dec. 31, 2004

(65) Prior Publication Data

US 2005/0167157 A1 Aug. 4, 2005

Related U.S. Application Data

(60) Provisional application No. 60/533,861, filed on Dec. 31, 2003.

(51) Int. Cl.
*E21B 47/12* (2006.01)

(52) U.S. Cl. ..... 175/40; 175/317; 73/152.48; 73/152.47

(58) Field of Classification Search ..... 175/40, 175/48, 24, 27, 57, 218, 317, 318; 340/856.3, 340/854.4, 856.4; 367/82, 81; 73/152.01, 73/152.43, 152.46, 152.47, 152.48, 152.49
See application file for complete search history.

(56) References Cited

U.S. PATENT DOCUMENTS 4,694,439 A * 9/1987 Moll ..... 367/83
4,903,245 A * 2/1990 Close et al. ..... 340/853.3
5,202,680 A * 4/1993 Savage ..... 340/853.1
5,202,681 A * 4/1993 Dublin et al. ..... 340/856.4
5,251,869 A 10/1993 Mason
5,339,864 A 8/1994 Carbaugh et al.
5,364,064 A 11/1994 Carlson et al.
5,410,303 A * 4/1995 Comeau et al. ..... 340/853.3
5,626,192 A * 5/1997 Connell et al. ..... 166/255.1
5,638,855 A 6/1997 Morrill
5,642,872 A 7/1997 Morrill
5,645,098 A 7/1997 Morrill
5,647,572 A 7/1997 Morrill
5,655,745 A 8/1997 Morrill
5,753,812 A * 5/1998 Aron et al. ..... 73/152.47
6,276,450 B1 8/2001 Seneviratne
6,736,207 B1 5/2004 Luca et al.
2002/0018399 A1 * 2/2002 Schultz ..... 367/81

* cited by examiner

*Primary Examiner*—Kenneth Thompson
(74) *Attorney, Agent, or Firm*—Christie, Parker & Hale, LLP

(57) ABSTRACT

An oil and gas well drilling system is provided that includes a torque drive system having an output shaft and a drill string rotated by the torque drive system. An instrumented internal blowout preventer valve is connected between the torque drive system output shaft and the drill string. The valve includes a valve housing, and one or more measurement devices mounted to the valve housing for measuring desired drill string drilling parameters during an oil and gas well drilling operation.

20 Claims, 3 Drawing Sheets

45
46
51
65
48
56
52/54
64
67
49
55
40
44
50
38
42
47
46

INSTRUMENTED INTERNAL BLOWOUT PREVENTER VALVE FOR MEASURING DRILL STRING DRILLING PARAMETERS

CROSS-REFERENCE TO RELATED APPLICATION

This application claims priority under 35 U.S.C. § 119(e) to U.S. Provisional Application Ser. No. 60/533,861, filed on Dec. 31, 2003, which is incorporated herein by reference.

FIELD OF THE INVENTION

The present invention relates generally to an oil and gas well drilling system, and more particularly to an apparatus and method for measuring drilling parameters during a drilling operation, such as drill string weight, torque, vibration, speed of rotation and/or internal pressure.

BACKGROUND OF THE INVENTION

Current methods of measuring and observing drilling parameters in an oil and gas well system during a drilling operation, such as drill string weight, torque, vibration, speed of rotation and internal pressure are generally indirect, meaning that they are measured at a point conveniently accessible but not necessarily located on the actual drill sting.

For example, the drill string weight is often indirectly measured by measuring the pull on a cable of a hoisting system, which raises and lowers the drill string. This type of measurement is inaccurate due to frictional forces associated with the cable, the sheaves, and the measurement device attached to the cable.

The drill string torque is difficult to measure since it is often difficult to measure the torque output of the torque driving system, which rotates or drives the drill string. For example, typically, the drill string is either rotated with a large mechanical drive called a rotary table or directly by a large motor called a top drive. The torque output of each of these drive systems cannot be easily measured and most often is either calculated from the current going to the drive motor when a top drive is used, or by measuring the tension of a drive chain which drives the rotary table when a rotary table is used. Both of these methods are very inaccurate and subject to outside influences that can cause the readings to be inconsistent, such as stray electrical currents through the drive motor when a top drive is used, or wear of the measured mechanical devices when a rotary table is used.

Another drilling parameter that is difficult to measure is vibration. Vibration of the drill string is very damaging to its components especially to the drill bit at the end of the drill string, which drills a well bore.

Various methods have been proposed to solve the above described problems with the measuring of drilling parameters during a drilling operation, including installing various instrumented pins onto components of the hoisting system or the torque drive system. Other more direct approaches have been tried with limited success. For example, some have installed a load sensor at the top of the derrick for measuring pull of the hoisting system on the derrick. These are commonly referred to as crown block weight sensors.

Various other devices have been developed for directly measuring torque and vibration on the drill string. For example, one such device for use with a rotary table includes a plate that attaches to the top of the rotary table between the table and a drive bushing, referred to as the kelly drive bushing. However, currently more and more oil and gas well drilling systems are using top drive drilling systems instead of rotary tables, rending this approach less desirable and possibly obsolete.

Others have tried to make special instrumented subs that screw directly into the drill string. One such device is large and bulky and does not fit into existing top drive systems. These devices provide the accuracy desired in the measure of the drilling parameters, but compromise the drilling equipment due to their size and shape. In addition, these devices require redesign of the torque drive system to accommodate them.

Accordingly, a need exists for an apparatus and method for accurately measuring drilling parameters during a drilling operation that does not require modification of the torque drive system to which it attaches.

SUMMARY OF THE INVENTION

In one embodiment, the present invention is an instrumented internal blowout preventer valve for connection between a torque drive system and a drill string, which is rotated by the torque drive system. The valve includes a valve housing, and one or more measurement devices mounted to the valve housing for measuring desired drill string drilling parameters during an oil and gas well drilling operation.

In another embodiment, the present invention is an oil and gas well drilling system that includes a torque drive system having an output shaft and a drill string rotated by the torque drive system. An instrumented internal blowout preventer valve is connected between the torque drive system output shaft and the drill string. The valve includes a valve housing, and one or more measurement devices mounted to the valve housing for measuring desired drill string drilling parameters during an oil and gas well drilling operation.

In yet another embodiment, the present invention is a method of measuring desired drill string drilling parameters during an oil and gas well drilling operation that includes providing a torque drive system; providing a drill string to be rotated by the torque drive system; and providing an instrumented internal blowout preventer valve for connection between the torque drive system and the drill string. The method also includes measuring the desired drill string drilling parameters by use of one or more measurement devices; and recording the desired drilling parameters and transmitting signals representative of the recorded drilling parameters to a receiver by use of an electronics package, wherein the receiver, in turn, passes the signals to an instrument on a drill floor displayed to a drilling operator so that the desired drill string drilling parameters may be observed during a drilling operation.

DETAILED DESCRIPTION OF THE DRAWINGS

Figure 1:
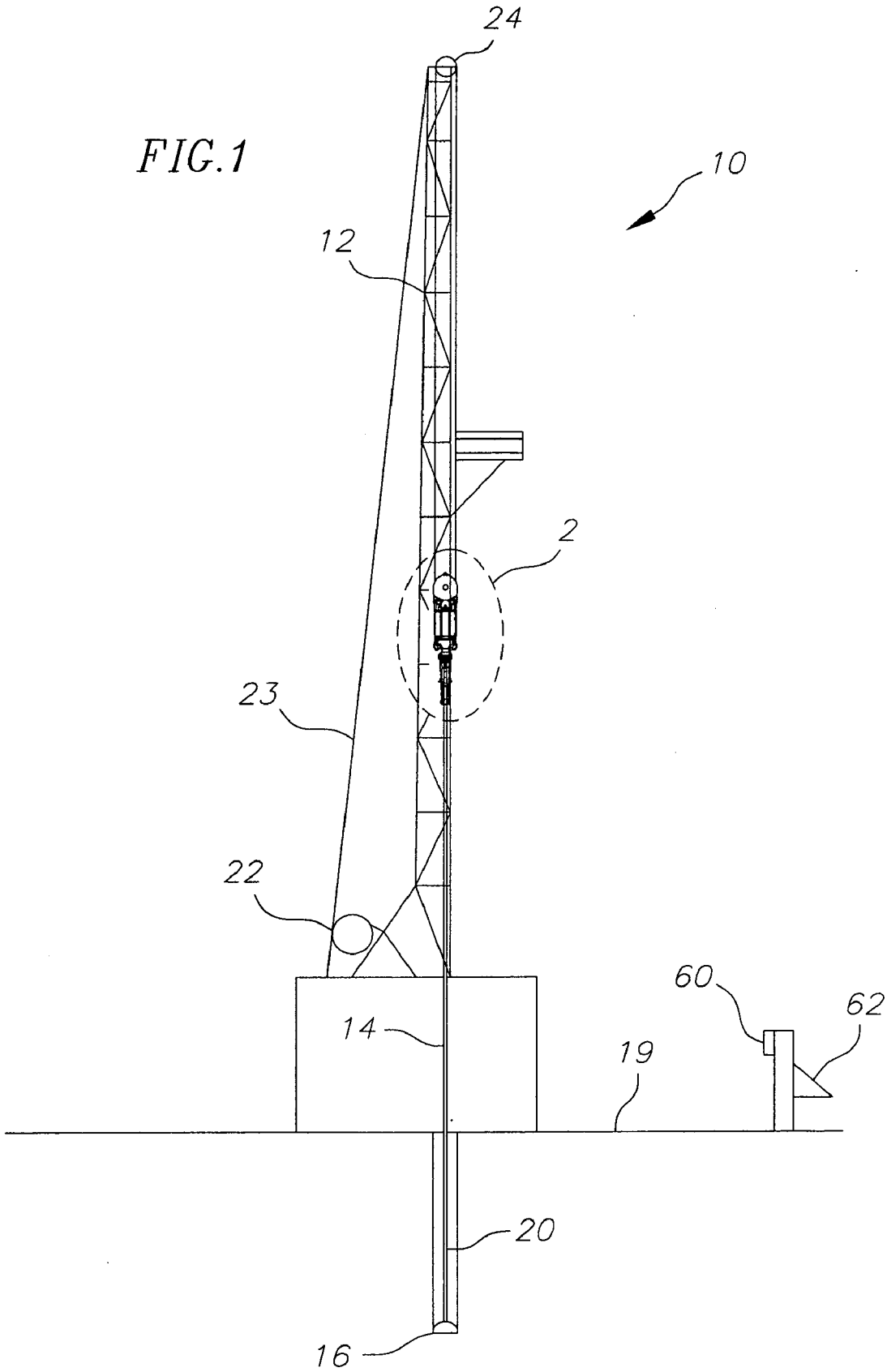
FIG. 1 is a side view of an oil and gas well drilling system according to one embodiment of the present invention, having an instrumented internal blowout preventer valve for measuring drill string drilling parameters during a drilling operation.
Figure 2:
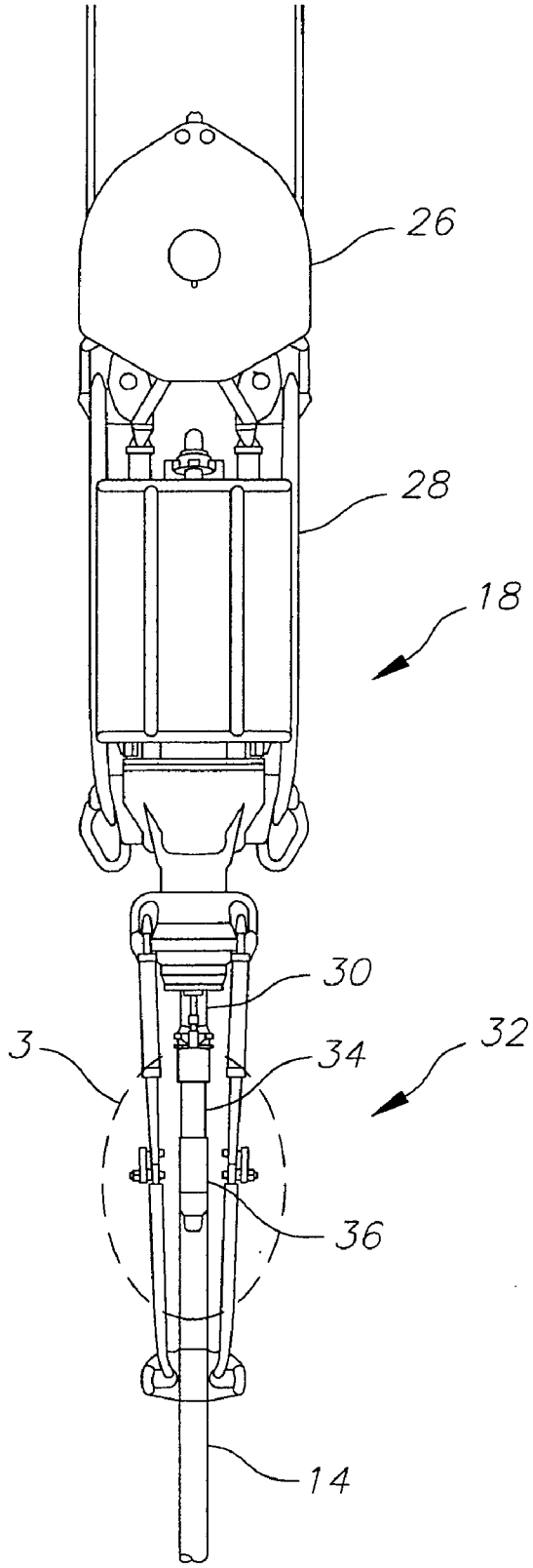
FIG. 2 is an enlarged side view of portion of the drilling system of FIG. 1, showing a top drive, upper and lower internal blowout preventer valves, and a drill string.
Figure 3:
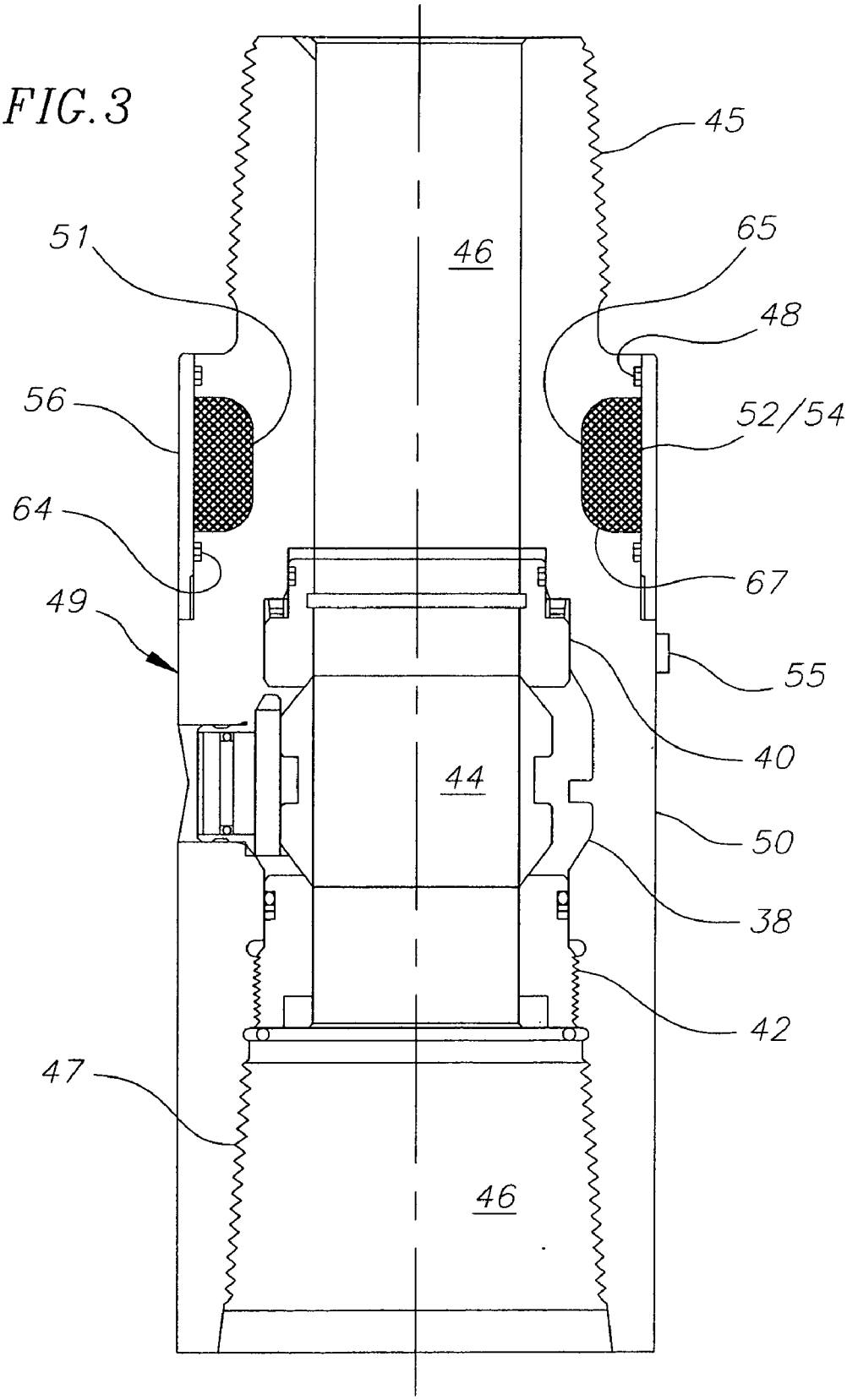
FIG. 3 is a cross-sectional view of an internal blowout preventer valve according to one embodiment of the present invention.
Figure 3:
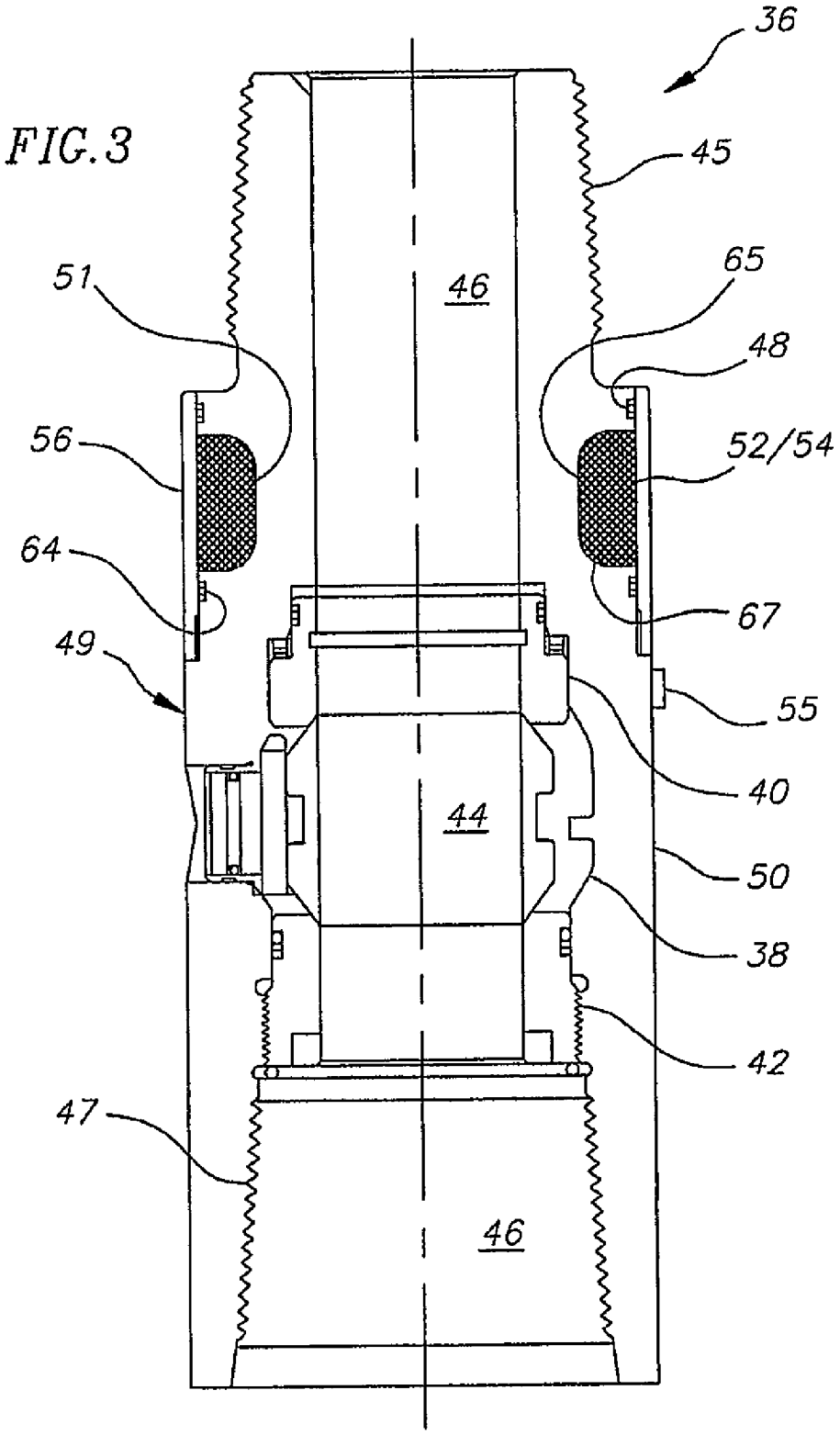

As shown in FIGS. 1–3, embodiments of the present invention are directed to an oil and gas well drilling system 10 having an instrumented internal blowout preventer valve (IBOP) 36 with measurement devices 52 mounted thereto for measuring desired drilling parameters of a drill string 14 during a drilling operation, such as drill string weight, torque, vibration, speed of rotation, and/or internal pressure.

Connecting the IBOP 36 to the drill string 14 below a torque drive system 18 and a hoist system 22, which raises and lowers the drill string 14, provides a direct approach for measuring the desired drilling parameters of the drill string 14, since the internal blowout preventer valve 36 is subjected to forces imparted on the drill string 14. In addition, most (if not all) torque drive systems 18 include at least one internal blowout preventer valve 36 to shut off the internal pressure in the drill string 14 if there is a kick or blowout in an associated well 20. Therefore, the instrumented IBOP 36 of the present invention allows for direct accurate measurements of the desired drilling parameters of the drill string 14 without the need for modification of the drilling equipment of the oil and gas well drilling system 10.

FIG. 1 shows an oil and gas well drilling system 10 according to one embodiment of the invention. In the depicted embodiment, the drilling system 10 includes a derrick structure 12 for supporting a string of drillpipe 14 (commonly referred to as a drill string), and a drill bit 16 attached to a lower end of the drill string 14. Within the derrick structure 12 is a means of rotating the drill string 14, or a torque drive system 18 (shown within detail circle 2 of FIG. 1, and enlarged in FIG. 2), which applies a torque to rotate the drill string 14, allowing the drill bit 16 to drill into a ground surface 19 to create a well bore 20. In the depicted embodiment, the torque drive system 18 is a top drive drilling system; however, in other embodiments the torque drive system 18 may be any other appropriate drive system.

Although not shown, the drilling system 10 also includes a pumping system for pumping a drilling fluid down the bore hole 20 through an inner diameter of the drill string 14, and back up the bore hole 20 externally from the drill string 14 in order to remove drill cuttings therefrom.

As is also shown in FIG. 1, the drill string 14 is suspended from the derrick 12 by a hoisting system 22, which includes a winch (commonly referred to as a drawworks) from which a cable 23 passes over a series of sheaves (commonly referred to as a crown block 24) at an upper end of the derrick 12, and down to a series of traveling sheaves (commonly referred to as a traveling block 26, shown within detail circle 2 of FIG. 1, and enlarged in FIG. 2.)

As shown in FIG. 2, attached to the traveling block 26 is a hook system for supporting the weight of the drill string 14. The amount of payout of the cable 23 from a winch drum of the drawworks 22 (shown in FIG. 1) determines the rate of drilling. As shown in FIGS. 1 and 2 together, located in the derrick 12 is the torque drive system 18, in this case, a top drive drilling system. The top drive drilling system 18 includes a motor 28 that is attached to the traveling block 26. An output shaft 30 of the motor 28 is connected to the drill string 14 to provide a drilling torque thereto. A reaction torque of the motor 28 is absorbed by a set of rails or a single rail (not shown) attached to the derrick 12 that permits the motor 18 to be raised and lowered, along with the drill string 14, by the drawworks 22.

During a drilling operation, it is desirable to measure and present to a drilling operator the force on the drill bit 16 and the torque and speed being imparted to the drill bit 16 along with other drilling parameters, such as drill string vibration and/or internal pressure. These readings are used by the drilling operator to optimize the drilling operation. In addition, other systems such as automatic devices for keeping the weight on the bit constant require signals representative of the torque, speed, and weight of the drill string 14, as well as the drilling fluid pressure.

Within the top drive drilling system 18 is a series of components used to perform various functions. As shown in FIGS. 2 and 3, one such component, disposed between the output shaft 30 of the motor 28 and an upper end of the drill string 14, is an internal blowout preventer valve (IBOP) assembly 32. The IBOP assembly 32 is used to close off the pressure inside the drill string 14 in the event that the well kicks or tries to blowout up through the inside of the drill string 14.

In the depicted embodiment of FIG. 2, the IBOP assembly 32 includes a upper internal blowout preventer valve (IBOP) 34 and a lower internal blowout preventer valve (IBOP) 36. In one embodiment, the upper IBOP 34 is connected at its upper end to the output shaft 30 of the motor 28, and at its lower end to an upper end of the lower IBOP 36. A lower end of the lower IBOP 36, in turn, is connected to an upper end of the drill string 14.

FIG. 3 shows a cross-section of the lower IBOP 36. As shown, the lower IBOP 36 includes a sealing ball 38 and sealing seats 40 and 42 rotatably receiving upper and lower portions of the ball 38, respectively, within a lower IBOP housing 49. The ball 38 has a fluid passageway 44 longitudinally extending therethrough. In the illustration of FIG. 3, the lower IBOP 36 is shown in an open position with its fluid passageway 44 aligned with a fluid passageway 46 in the lower IBOP housing 49 extending above and below the ball 38. The lower IBOP 36 may be moved to a closed position by rotating the ball 38 ninety degrees from the position shown in FIG. 3 (the open position.) to allow the ball 38 to seal off or prevent a fluid flow from above and below the ball 38.

Although details of the upper IBOP 34 are not shown, the upper IBOP 34 similarly may include a sealing ball having a fluid passageway longitudinally extending therethrough, and sealing seats that rotatably receive upper and lower portions of the ball. The ball of the upper IBOP 34 may also be moved between an open and a closed position to allow or prevent a fluid flow from above and below the ball.

Referring back to FIG. 3, the lower IBOP 36 includes upper threads 45 for engagement with threads on a lower end of the upper IBOP 36, and lower threads 47 for engagement with threads on an upper end of the drill string 14. Similarly, the upper IBOP 34 includes upper threads (not shown) for engagement with threads on a lower end of the output shaft 30 of the motor 28, and lower threads (not shown) for engagement with the upper threads 45 of the lower IBOP 36.

By connecting the lower IBOP 36, between the output shaft 30 of the motor 28 (via the upper IBOP 34), and the upper end of the drill string 14, the lower IBOP 36 is subjected to loads imparted on the drill string 14 and hence on the drill bit 16. As such, the lower IBOP 36 receives the actual torque imparted by the drilling motor 28 on the drill string 14, as well as the actual tension in the drill string 14, and the same speed of rotation as the drill string 14. In addition, the lower IBOP 36 is subjected to the vibration imparted on the drill string 14, and since the drilling fluid passes through the fluid passageways 44 and 46 of the lower IBOP 36, the lower IBOP 36 develops the same internal pressure as that in the drill string 14. Therefore by measuring the torque, weight, vibration, speed of rotation, and internal pressure of the lower IBOP 36, the torque, weight, vibration, speed of rotation and internal pressure of the drill string 14 can be determined.

As shown in FIG. 3, an upper portion of the lower IBOP 36 includes a recessed portion 48 having a smaller diameter than a remainder of the outside diameter 50 of the lower IBOP housing 49. As shown, disposed within the recessed portion 48 is an annular groove 51, having an inner surface 65 which forms an even smaller diameter. Mounted within the annular groove 51 are measurement devices 52 (schematically represented) for measuring the drilling parameters of the drill string 14 during a drilling operation, and an electronics package 54 (schematically represented) for recording the drilling parameters and transmitting signals to the drill floor so that the drilling operator may observe the drilling parameters during a drilling operation.

The measurement devices 52 may include one or more, or any combination of one or more drilling parameter measuring devices, such as a strain gauges for measuring drill string weight and torque, an accelerometer for measuring drill string vibration, a pressure transducer for measuring the internal pressure of the drill string 14, or any other appropriate drilling parameter measurement device.

In one embodiment, the measurement devices 52 include strain gauges for measuring the stress at the surface of the annular groove 51 in the recessed portion 48 of the lower IBOP housing 49, mounted in directions to measure the torsional stress or torque, and the axial stress or tension on the lower IBOP 36. These strain gauges are calibrated to measure the actual torque and tension on the drill string 14. For example, in one embodiment, the measurement devices 52 include a strain gauge, such as a load cell, mounted on the inner surface 65 of the annular groove 51. As mentioned above, the inner surface 65 of the annular groove 51 is formed to a smaller diameter than the outside diameter 50 of the lower IBOP housing 49, such that the strain on this inner surface 65 is magnified and therefore easier to detect. In addition, the corners 67 of the annular groove 51 may be radiused, rather than square, in order to reduce localized strains at the corners 67. This also serves to concentrate the strain on the inner surface of the annular groove 51, facilitating the detection of the strain.

In one embodiment, the measurement devices 52 include a further strain gauge calibrated to measure the vibration of the lower IBOP 36, and hence the vibration of the drill string 14. Alternatively, the measurement devices 52 may include an accelerometer calibrated to measure the vibration of the lower IBOP 36, and hence the vibration of the drill string 14.

In another embodiment, the measurement devices 52 include another further strain gauge calibrated to measure the internal pressure of the lower IBOP 36, and hence the internal pressure of the drill string 14. Alternatively, the measurement devices 52 may include a pressure transducer calibrated to measure the internal pressure of the lower IBOP 36, and hence the internal pressure of the drill string 14. In another such case, the measurement devices 52 include a device, such as a pressure transducer, placed in fluid communication with the fluid passageway 46 of the lower IBOP 36.

In yet another embodiment, the measurement devices 52 include a tachometer calibrated to measure the speed of rotation of the lower IBOP 36, and hence the speed of rotation of the drill string 14. Alternatively, the measurement devices 52 may include a further accelerometer calibrated to measure the speed of rotation of the lower IBOP 36, and hence the speed of rotation of the drill string 14.

The electronics package 54 may include electronic strain gauge amplifiers, signal conditioners, and a wireless signal transmitter connected to a patch antenna 55 (schematically represented) located on the outer surface or outer diameter 50 of the lower IBOP housing 49. The electronics package 54 records the measured drilling parameters of the drill string 14, such as torque, weight, speed, vibration and/or internal pressure, and transmits signals representative of these parameters to a receiver 60 (schematically represented in FIG. 1) located on the drill floor 19. The receiver 60, in turn, passes the signals to an instrument or computer 62 (schematically represented in FIG. 1) viewable by the drilling operator so that the drilling parameters of the drill string 14 may be observed during a drilling operation.

The power for the electronics package 54 may be obtained in any one of a variety of ways. For example, in one embodiment, the electronics package 54 includes replaceable batteries removably disposed therein. In another embodiment, power is transmitted to the electronics package 54 from a stationary power antenna located around the outside of the lower IBOP 36 to a receiving antenna located on the lower IBOP 36. In a still further embodiment, power is provided to the electronics package 54 through a standard slip ring.

As shown in FIG. 3, a thin walled sleeve 56 is received within the recessed portion 48 of the lower IBOP housing 49 to close off the annular groove 51 where the measurement devices 52 and the electronics package 54 are mounted. The sleeve 56 serves to protect the measurement devices 52 and the electronics package 54 from damage and exposure to the external environment and/or elements. In one embodiment, the sleeve 56 is treadably connected to a threaded portion of the recessed portion 48. O-rings 64 may also be disposed between the recessed portion 48 of the lower IBOP housing 49 and the sleeve 56 at a position above and below the annular groove 51 to further protect the measurement devices 52 and the electronics package 54.

Although the torque drive system 18 is described above as a top drive drilling system, in other embodiments in accordance with the present invention, the torque drive system 18 may include a rotary table drive system, or any other appropriate drive system which incorporates an internal blowout preventer valve. In addition, although the measurement devices 52 and the electronics package 54 are described as being mounted on the lower IBOP 36, in other embodiments in accordance with the present invention, the measurement devices 52 and the electronics package 54 may be mounted to the upper IBOP 34 or to any other component of the drill string 14 such as a saver sub, which is customarily connected between the lower IBOP 36 and the drill string 14.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. An instrumented internal blowout preventer valve for connection between a torque drive system and a drill string, which is rotated by the torque drive system, comprising:

a valve housing having an annular groove in which the one or more measurement devices are mounted; and one or more measurement devices mounted to the valve housing for measuring desired drill string drilling parameters during an oil and gas well drilling operation; and a protective sleeve mounted adjacent to the annular groove to protect the one or more measurement devices mounted therein.

2. The valve of claim 1, further comprising an electronics package mounted to the valve housing for recording the desired drill string drilling parameters, and transmitting signals to a drill floor so that a drilling operator may observe the drilling parameters during a drilling operation.

3. The valve of claim 1, wherein an electronics package is mounted in the annular groove of the valve housing.

4. The valve of claim 3, further comprising a protective sleeve mounted adjacent to the annular groove to protect the one or more measurement devices and the electronics package mounted therein.

5. The valve of claim 1, wherein the one or more measurement devices comprise a measurement device calibrated to measure a weight of the drill string.

6. The valve of claim 1, wherein the one or more measurement devices comprise a measurement device calibrated to measure a torque imparted on the drill string.

7. The valve of claim 1, wherein the one or more measurement devices comprise a measurement device calibrated to measure a speed of rotation of the drill string.

8. The valve of claim 1, wherein the one or more measurement devices comprise a measurement device calibrated to measure a vibration imparted on the drill string.

9. The valve of claim 1, wherein the one or more measurement devices comprise a measurement device calibrated to measure an internal pressure of the drill string.

10. The valve of claim 1, wherein mounted within the valve housing is a sealing ball and sealing seats rotatably receiving the ball, such that the sealing ball is movable between an open position and a closed position to allow or prevent, respectively, fluid flow from above and below the ball.

11. An oil and gas well drilling system comprising:

a torque drive system having an output shaft;

a drill string rotated by the torque drive system; and an instrumented internal blowout preventer valve for connection between the torque drive system output shaft and the drill string, wherein the valve comprises:

a valve housing, and one or more measurement devices mounted to the valve housing for measuring desired drill string drilling parameters during an oil and gas well drilling operation.

12. The drilling system of claim 11, wherein the valve further comprises an electronics package mounted to the valve housing for recording the desired drill string drilling parameters, and transmitting signals to a drill floor so that a drilling operator may observe the drilling parameters during a drilling operation.

13. The drilling system of claim 11, wherein the valve housing comprises an annular groove in which the one or more measurement devices are mounted.

14. The drilling system of claim 13, wherein an electronics package is mounted in the annular groove of the valve housing.

15. The drilling system of claim 11, wherein the one or more measurement devices comprise a measurement device calibrated to measure a weight of the drill string.

16. The drilling system of claim 11, wherein the one or more measurement devices comprise a measurement device calibrated to measure a torque imparted on the drill string.

17. The drilling system of claim 11, wherein the torque drive system is a top drive drilling system.

18. A method of measuring desired drill string drilling parameters during an oil and gas well drilling operation comprising;

providing a torque drive system;

providing a drill string to be rotated by the torque drive system;

providing an instrumented internal blowout preventer valve for connection between the torque drive system and the drill string;

measuring the desired drill string drilling parameters by use of one or more measurement devices; and recording the desired drilling parameters and transmitting signals representative of the recorded drilling parameters to a receiver by use of an electronics package, wherein the receiver, in turn, passes the signals to an instrument on a drill floor viewable by a drilling operator so that the desired drill string drilling parameters may be observed during a drilling operation.

19. The method of claim 18, wherein the one or more measurement devices comprise a measurement device calibrated to measure a weight of the drill string.

20. The method of claim 18, wherein the one or more measurement devices comprise a measurement device calibrated to measure a torque imparted on the drill string.

* * * * *

UNITED STATES PATENT AND TRADEMARK OFFICE

CERTIFICATE OF CORRECTION

PATENT NO. : 7,108,081 B2
APPLICATION NO. : 11/027849
DATED : September 19, 2006
INVENTOR(S) : Boyadjieff It is certified that error appears in the above-identified patent and that said Letters Patent is hereby corrected as shown below:

On the Title Page

| | |
|---|---|
| (56) References Cited<br>U.S. Patent Documents<br>6,736,207. . . | Delete “B1”,<br>Insert --B2-- |

In the Specification

| | |
|---|---|
| Column 2, line 3 | Delete “rending”,<br>Insert --rendering-- |
| Column 3, line 63 | Delete “18”,<br>Insert --28-- |
| Column 4, line 36 | Delete “position.)”,<br>Insert --position)-- |

In the Claims

| | |
|---|---|
| Column 6, line 67, Claim 1 | Delete “mounted; and”,<br>Insert --mounted;-- |
| Column 8, line 25, Claim 18 | Delete “comprising;”,<br>Insert --comprising:-- |

UNITED STATES PATENT AND TRADEMARK OFFICE

CERTIFICATE OF CORRECTION

PATENT NO. : 7,108,081 B2
APPLICATION NO. : 11/027849
DATED : September 19, 2006
INVENTOR(S) : Boyadjieff It is certified that error appears in the above-identified patent and that said Letters Patent is hereby corrected as shown below:

In the Drawings

| | |
|---|---|
| FIG. 3, Sheet 3 of 3 | Delete Drawing Sheet 3 and substitute therefore the Drawing Sheet, consisting of Fig. 3, as shown on the attached page |

Signed and Sealed this

Twenty-first Day of August, 2007

JON W. DUDAS
*Director of the United States Patent and Trademark Office*

(12) United States Patent
Boyadjieff

(10) Patent No.: US 7,108,081 B2
(45) Date of Patent: Sep. 19, 2006

(54) INSTRUMENTED INTERNAL BLOWOUT PREVENTER VALVE FOR MEASURING DRILL STRING DRILLING PARAMETERS

(75) Inventor: George Boyadjieff, Villa Park, CA (US)

(73) Assignee: Varco I/P, Inc., Orange, CA (US)

( * ) Notice: Subject to any disclaimer, the term of this patent is extended or adjusted under 35 U.S.C. 154(b) by 11 days.

(21) Appl. No.: 11/027,849

(22) Filed: Dec. 31, 2004

(65) Prior Publication Data

US 2005/0167157 A1 Aug. 4, 2005

Related U.S. Application Data

(60) Provisional application No. 60/533,861, filed on Dec. 31, 2003.

(51) Int. Cl.
*E21B 47/12* (2006.01)

(52) U.S. Cl. ..... 175/40; 175/317; 73/152.48; 73/152.47

(58) Field of Classification Search ..... 175/40, 175/48, 24, 27, 57, 218, 317, 318; 340/856.3, 340/854.4, 856.4; 367/82, 81; 73/152.01, 73/152.43, 152.46, 152.47, 152.48, 152.49
See application file for complete search history.

(56) References Cited

U.S. PATENT DOCUMENTS 4,694,439 A * 9/1987 Moll ..... 367/83
4,803,245 A * 2/1990 Close et al. ..... 340/853.3
5,202,688 A * 4/1993 Savage ..... 340/853.1
5,202,681 A * 4/1993 Dublin et al. ..... 340/856.4
5,251,869 A 10/1993 Mason
5,339,864 A 8/1994 Carbaugh et al.
5,364,004 A 11/1994 Carlson et al.
5,410,303 A * 4/1995 Comeau et al. ..... 340/853.3
5,626,192 A * 5/1997 Connell et al. ..... 166/255.1
5,638,855 A 6/1997 Morrill
5,642,872 A 7/1997 Morrill
5,645,098 A 7/1997 Morrill
5,647,572 A 7/1997 Morrill
5,655,745 A 8/1997 Morrill
5,753,812 A * 5/1998 Aron et al. ..... 73/152.47
6,276,450 B1 8/2001 Seneviratne
6,736,207 B1 5/2004 Luca et al.
2002/0018399 A1 * 2/2002 Schultz ..... 367/81

* cited by examiner

*Primary Examiner*—Kenneth Thompson
(74) *Attorney, Agent, or Firm*—Christie, Parker & Hale, LLP

(57) ABSTRACT

An oil and gas well drilling system is provided that includes a torque drive system having an output shaft and a drill string rotated by the torque drive system. An instrumented internal blowout preventer valve is connected between the torque drive system output shaft and the drill string. The valve includes a valve housing, and one or more measurement devices mounted to the valve housing for measuring desired drill string drilling parameters during an oil and gas well drilling operation.

20 Claims, 3 Drawing Sheets

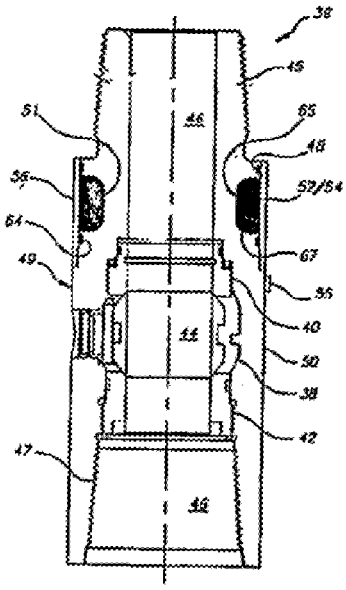

36
45
46
65
51
48
56
52/54
64
67
49
55
40
44
50
38
42
47
46